US007384167B1

(12) United States Patent
Gamache et al.

(10) Patent No.: US 7,384,167 B1
(45) Date of Patent: Jun. 10, 2008

(54) OPTIMAL WALL WASHING KICK REFLECTOR

(75) Inventors: Tom Gamache, Fall River, MA (US); Peter Franck, Fall River, MA (US); Sherman Ng, South Dartmouth, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 100 days.

(21) Appl. No.: 11/098,284

(22) Filed: Apr. 4, 2005

(51) Int. Cl.
*F21V 17/02* (2006.01)

(52) U.S. Cl. ..... 362/147; 362/148; 362/366; 362/365

(58) Field of Classification Search ..... 362/364, 362/366, 148, 365, 147
See application file for complete search history.

(56) References Cited

U.S. PATENT DOCUMENTS

| | | | | |
|---|---|---|---|---|
| 5,031,084 | A | | 7/1991 | Russo et al. |
| 5,032,959 | A | | 7/1991 | Brass |
| 5,045,985 | A | | 9/1991 | Russo et al. |
| 5,086,375 | A | | 2/1992 | Fabbri et al. |
| 5,124,901 | A | | 6/1992 | Sojka et al. |
| 5,130,914 | A | | 7/1992 | Bengochea |
| 5,140,301 | A | | 8/1992 | Watanabe |
| 5,146,248 | A | | 9/1992 | Duwaer et al. |
| 5,217,299 | A | | 6/1993 | Yoshida et al. |
| 5,236,157 | A | | 8/1993 | Reggiani |
| 5,251,116 | A | | 10/1993 | Wijbenga et al. |
| 5,291,381 | A | | 3/1994 | Price |
| 5,335,151 | A | | 8/1994 | Dahlberg |
| 5,373,431 | A | | 12/1994 | Hayman et al. |
| 5,375,045 | A | | 12/1994 | Ruud et al. |
| 5,379,195 | A | | 1/1995 | Epstein |
| 5,416,683 | A | | 5/1995 | McCarthy |
| 5,416,684 | A | | 5/1995 | Pearce |
| 5,426,575 | A | | 6/1995 | Richards |
| 5,434,765 | A | | 7/1995 | Kelly et al. |
| 5,438,495 | A | | 8/1995 | Ahlen et al. |
| 5,440,471 | A | | 8/1995 | Zadeh |
| 5,457,617 | A | | 10/1995 | Chan et al. |
| 5,486,989 | A | | 1/1996 | Compton |
| 5,493,483 | A | | 2/1996 | Lake |
| 5,526,248 | A | | 6/1996 | Endo |
| 5,562,343 | A | * | 10/1996 | Chan et al. ..... 362/365 |
| 5,582,479 | A | | 12/1996 | Thomas et al. |
| 5,584,575 | A | | 12/1996 | Fickel |
| 5,658,067 | A | | 8/1997 | Engle et al. |
| 5,662,413 | A | | 9/1997 | Akiyama |
| 5,673,997 | A | | 10/1997 | Akiyama |
| 5,676,448 | A | | 10/1997 | Urbaing |
| 5,707,143 | A | | 1/1998 | Hentz |
| 5,725,302 | A | | 3/1998 | Sirkin |
| 5,743,627 | A | | 4/1998 | Casteel |

(Continued)

*Primary Examiner*—Anabel M Ton
(74) *Attorney, Agent, or Firm*—John F. Salazar; Middleton Reutlinger

(57) ABSTRACT

A recessed downlight wall wash reflector assembly having a wall wash reflector installable into a standard mounting frame for a recessed downlight reflector having a similarly sized light exit aperture. The reflector assembly has a downlight reflector, a window cutout in the wall of the downlight reflector and a wall wash reflector attached to the reflector assembly such that it is positioned behind the window cutout and has a lower tab that extends into the lower portion of the window cutout providing for a higher angle of reflection of light from nadir.

18 Claims, 7 Drawing Sheets

U.S. PATENT DOCUMENTS 5,758,959 A 6/1998 Sieczkowski
5,791,768 A 8/1998 Splane, Jr.
5,800,050 A 9/1998 Leadford
5,813,744 A 9/1998 Altebarmakian
5,816,694 A 10/1998 Ideker et al.
5,826,970 A 10/1998 Keller et al.
5,836,678 A 11/1998 Wright et al.
5,851,061 A 12/1998 Hegarty
5,857,766 A 1/1999 Sieczkowski
D412,040 S 7/1999 Hudak et al.
5,957,573 A 9/1999 Wedekind et al.
5,967,363 A 10/1999 Allen
5,977,694 A 11/1999 McGuire
6,000,818 A 12/1999 Caluori
6,004,011 A 12/1999 Sieczkowski
6,019,477 A 2/2000 Wegrzyn et al.
6,027,231 A 2/2000 Fouke
6,033,093 A 3/2000 Latsis et al.
6,036,338 A 3/2000 Gordin
6,042,251 A 3/2000 McCarthy et al.
6,045,232 A 4/2000 Buckmaster
6,050,708 A 4/2000 Roorda
D425,221 S 5/2000 Burns
6,062,704 A 5/2000 Holder
6,082,031 A 7/2000 Heaton et al.
6,095,669 A 8/2000 Cho
6,095,671 A 8/2000 Hutain
6,116,749 A 9/2000 Quiogue et al.
RE36,908 E 10/2000 Ling
6,126,300 A 10/2000 Lee
6,164,802 A 12/2000 Gromotka
D437,077 S 1/2001 Minissi et al.
6,168,294 B1 1/2001 Erni et al.
6,170,967 B1 1/2001 Usher et al.
6,174,069 B1 1/2001 Plunk et al.
6,217,197 B1 4/2001 Siminovitch et al.
6,250,776 B1 6/2001 Burkitt et al.
6,283,430 B1 9/2001 Schubert et al.
6,350,047 B1 * 2/2002 Ng et al. ..... 362/364
6,364,152 B1 4/2002 Poslinski et al.
6,371,630 B1 4/2002 Unger
6,425,680 B1 7/2002 Rippel et al.
6,447,145 B1 9/2002 Thomas et al.
6,478,453 B2 11/2002 Lammers et al.
6,478,454 B1 11/2002 Jaffari et al.
6,554,457 B1 4/2003 Platt
6,561,670 B1 5/2003 Jongewaard et al.
6,619,821 B1 9/2003 Waycaster
6,632,006 B1 * 10/2003 Rippel et al. ..... 362/366
6,655,813 B1 12/2003 Ng
6,723,588 B2 4/2004 Kim
6,969,181 B1 11/2005 Bailey et al.
7,001,039 B1 * 2/2006 Aubrey ..... 362/147
2005/0227536 A1 10/2005 Gamache et al.

* cited by examiner

OPTIMAL WALL WASHING KICK REFLECTOR

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

This invention relates to recessed light fixture reflector assemblies, and particularly to downlight wall wash reflector assemblies which provide an optimum reflection onto the wall near the plane of the ceiling.

DESCRIPTION OF PRIOR ART

Recessed light fixtures are light fixtures which are recessed behind a planar surface, such as a ceiling, wall, or floor. The fixtures are designed such that light exits the fixture through a hole or opening in the planar surface. The fixtures are primarily used in ceilings. Since generally no components of the fixture hang down below the plane of the ceiling, use of the fixtures allows lighting designers to illuminate a workspace while maintaining a smooth ceiling line. Thus, illumination is provided while the source of the light is, in effect, concealed.

Since the light source is located completely above the ceiling, efficiency concerns require the light from the source to be collected and focused downward and outward through the opening. Typically, this is accomplished through the use of a reflector assembly located above and around the sides of the light source directing the light downward and outward. However, it is desirable to shield the light source and reflections of the light source in the reflector assembly from normal viewing angles in the room. Direct view of the light source, or even a reflection of the light source in the reflector assembly, will create glare and uncomfortable brightness to an observer in the room. Thus, it is generally desirable in a home or workplace environment that the light from a recessed downlight reflector be focused outward at low angles, i.e. approximately 50 degrees or less, as measured from the nadir of the fixture. This angular measurement has been determined to shield an observer looking across the room from glare, while allowing each fixture to illuminate a reasonably sized area.

Utilizing today's commonly available light sources, including incandescent, fluorescent, low voltage, metal halide, and high intensity discharge (HID), recessed downlight reflectors are generally conical in shape, have round light exit apertures, and produce a generally conical shaped area of illumination. Thus, the illumination of the room can be accomplished by the arrangement of multiple recessed downlight fixtures such that their output light patterns produce the desired result.

The placement of a recessed downlight fixture in proximity to a wall or other vertical surface produces a scalloped illumination pattern as the vertical surface intersects the cone of light produced by the downlight reflector. This scalloped illumination effect is often undesirable and occasionally unacceptable. Thus, lighting designers often desire for recessed fixtures located close to walls to project light at both high and low angles toward the walls to evenly illuminate them from the ceiling to the floor, in effect washing the walls with light. However, it is desirable that light directed toward the room from such fixtures remain directed at lower angles to prevent glare. This requires the use of two different reflector designs in the same fixture: 1) the downlight reflector design to direct room side light downward and outward at low angles; and 2) a wall wash reflector or kick reflector to direct light primarily outward to illuminate the wall from near the plane of the ceiling to the floor. Thus, a recessed downlight wall wash reflector or kick reflector combines both downlight and wall wash light.

Additionally, it is desired that the ceiling opening and the appearance of the downlight wall wash fixture match the appearance of downlight only fixtures located elsewhere in the room.

Further complicating matters, it is often desirable to provide kick reflectors that optimize the wall washing light by minimizing the distance from the plane of the ceiling down the wall to the wall wash light. For instance, typical kick reflectors have a reflecting surface that terminates well above the light exit aperture of the luminaire. Additionally, windows cut out in the down light reflector terminate above a trim flange thus shielding the lower edge of the wall wash reflector. This configuration limits the angle at which the light may be reflected toward the wall, thus leaving a large area of darkness on the wall above the wall washing light.

Further, it is sometimes desirable to equip recessed fixtures having vertical surfaces on more than one side, such as hallways and corners, with wall wash reflectors to wash each vertical surface. The desired result can be achieved by outfitting the fixtures with multiple wall wash reflectors in either a double (parallel or opposite) configuration for a hallway, or a perpendicular configuration for a corner.

BRIEF SUMMARY OF THE INVENTION

Thus, it is an object of the present invention to provide an improved downlight wall wash reflector or kick reflector assembly installable into standard recessed downlight reflectors having wall wash windows providing optimal wall washing capability.

It is another object of the present invention to provide a recessed downlight wall wash reflector assembly having a downlight reflector with a window cutout where the wall wash reflector of the present invention is positioned to provide wall washing opposite the wall wash reflector and downlighting around the rest of the reflector.

It is a further object of the present invention to provide an improved downlight wall wash reflector assembly having single, double and corner wall wash configurations.

Other embodiments of the recessed downlight wall wash reflector assembly of the present invention address having a variety of standard downlight reflectors with different shaped surfaces and wall wash window cutouts. Various configurations of the downlight/wall wash reflector assemblies of the present invention are claimed herein so that a variety of down light reflector configurations may provide optimal wall washing light.

These and other objectives are accomplished by the present invention by providing a kick or wall wash reflector having a partial ellipsoidal shape and having a downwardly extending tab. The tab extends into the lower edge of the wall wash window in the standard downlight reflector and terminates near the plane of the ceiling. This tab provides a reflective surface near the light exit aperture of the luminaire and reflects incident light near parallel to the plane of the ceiling. This configuration optimizes the wall washing capability of the luminaire by minimizing the dark areas on the wall near the plane of the ceiling.

DETAILED DESCRIPTION OF THE PREFERRED EMBODIMENTS

The objects of the present invention may be accomplished in several embodiments. The preferred embodiment will be determined by the configuration, single, double or corner wall washer, of the reflector assembly as well as the shape of the downlight reflector and wall wash window to achieve the desired results. References to the figures are made to provide for a detailed description of the present invention.

Figure 1:
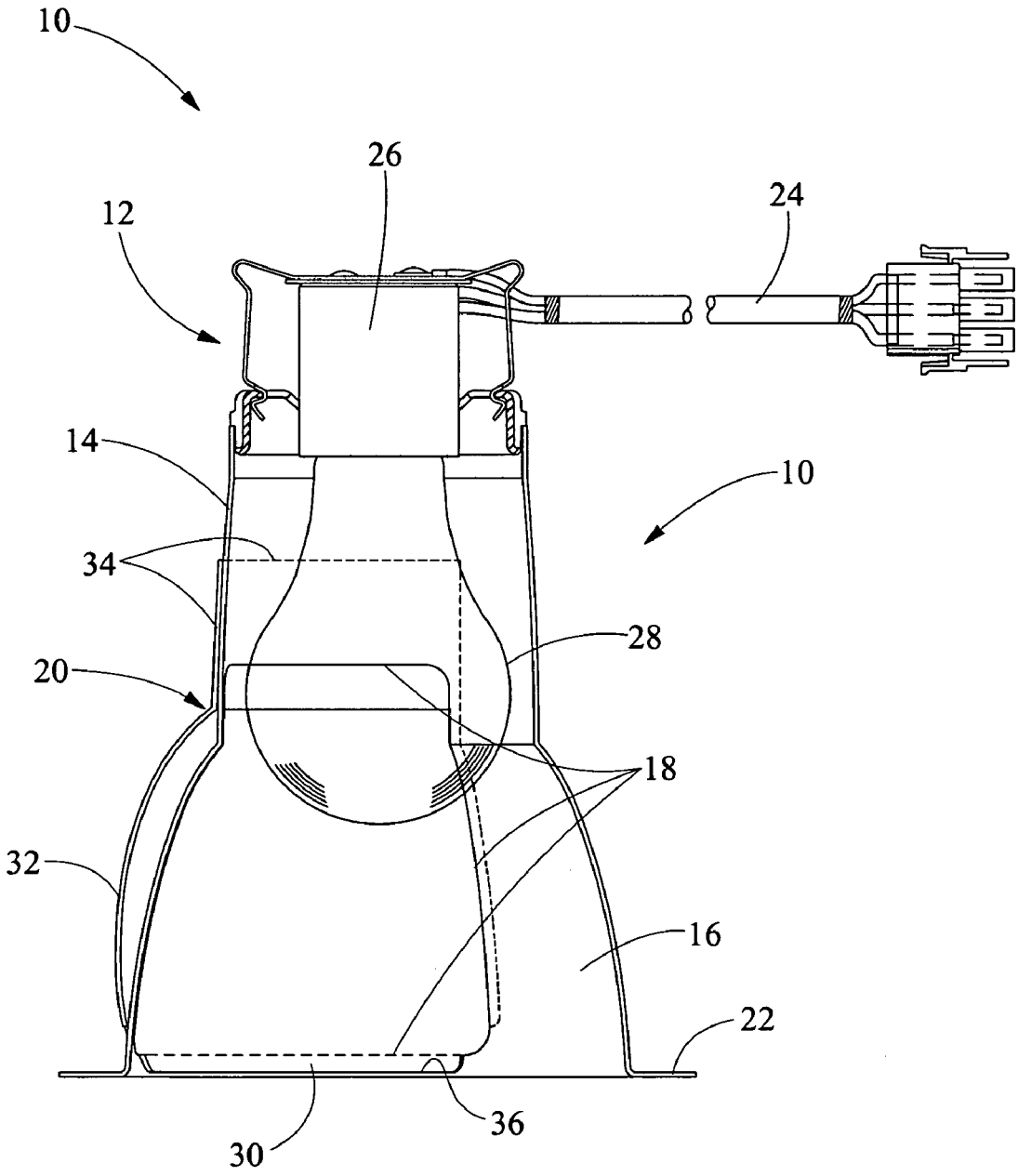
FIG. 1 is a cross-sectional view of one embodiment of a recessed downlight single wall wash reflector assembly of the present invention. A lower portion of a window cutout underlying the wall wash reflector and an upper portion of a wall wash reflector are shown in phantom lines to convey the wall wash reflector passing through the window cut-out.

FIG. 1 shows a recessed downlight wall wash reflector assembly 10 configured for use as a single wall washer. The orientation of the luminaire in FIG. 1 is such that the left cross-sectional cut passes along the window cutout. The luminaire in this embodiment is designed for use with an incandescent lamp light source 28 and has a socket cup receiving neck 26, a light source positioning section 14, a downlight reflector section 16, a window cutout 18, a wall wash reflector 20 and a trim flange 22. The assembly may be fabricated from aluminum or any other suitable material such that the reflector assembly 10 has the strength and rigidity to support a socket cup and lamp assembly, thus eliminating the requirement for a separate fixture housing. Further shown in FIG. 1 is the wiring 24 of the fixture to an external power source and to the socket cup assembly 26.

The light source positioning section 14 is located substantially below the socket cup receiving neck 26. This section may be open at the top and bottom. Light source positioning section 14 is attached to the socket cup receiving neck 26 and downlight reflector section 16 at its top and bottom, respectively. Lamp 28 extends through light source positioning 14 and slightly into the downlight reflector section 16. The light source positioning section 14 may have a slight tapering curve to its walls to transition from the diameter of the upper end of the downlight reflector section 16 to the lower end of the socket cup receiving neck 26. The shape of the light source positioning section 14 is primarily for ease of manufacture. The material of the light source positioning section 14 is typically comprised of an unfinished aluminum. The primary purpose of light source positioning section 14 is to position lamp 28 in proper relation to the downlight and wall wash reflectors 16 and 20 so that the desired effects of optimum and even illumination of a wall and glare free room side illumination are achieved.

The downlight reflector section 16 is located below the light source positioning section 14 and attached thereto around the light source positioning section's 14 lower edge. Actually, in a preferred embodiment, downlight reflector section 16 and light source positioning section 14 have a unitary construction, but are described herein as sections according to their function. The downlight reflector section 16 is also open at its top and bottom. The downlight reflector section 16 is designed to deliver the maximum available light from lamp 28 while shielding lamp 28 from normal viewing angles to prevent uncomfortable brightness or glare to the viewer. It is typically made of aluminum and its interior reflective surface is polished to a specular finish. The bottom of the downlight reflector section 16 is open to the room below and is referred to as the light exit aperture 30.

Extending outward from the bottom end of the downlight reflector section 16 is an annular trim flange 22. The purpose of the trim flange 22 is to cover the rough appearance of the hole in the ceiling and to provide a smooth transition from the ceiling into the reflector assembly 10.

A window cutout 18 is shown, window cutout 18 allows light from the lamp to be reflected off of the wall wash reflector 20, which is attached to the assembly such that it is positioned generally behind window cutout 18. Window cutout 18 extends from just slightly trim flange 22 upward into the light source positioning section 14 about ⅓ of the distance from the bottom of light source positioning section 14 toward socket cup receiving neck 26. In the embodiment shown, the angular width of the window cutout 18 is approximately 120°. This is shown in FIG. 1 in that the left cross-sectional cut in luminaire 10, along an edge of wall wash reflector 20, and the other edge of wall wash reflector 20, shown in phantom lines, shows the wall washer reflector 20 to horizontally span about two thirds of the 180° cross-section.

The wall wash reflector 20 is comprised of a kick reflector 32 having flange 34 formed at the upper end of the kick reflector 32. Kick reflector 32 is specifically designed, in conjunction with the herein described window cutout 18, to direct light from lamp 28 to illuminate the adjacent wall evenly from near the ceiling line to the floor. Flange 34 is shaped to match the contour of the light source positioning section 14. The lower edge of kick reflector 32 has a tab 36 extending into the lower portion of window 18. Tab 36 extends to near the plane of the wall or ceiling in which luminaire 10 is mounted or plane formed by trim flange 22 and provides for a lower reflective surface than kick reflectors found in the prior art. Downwardly extending tab 36 allows wall wash reflector 20 to reflect light onto the wall very near the plane of the ceiling in which it is mounted.

Wall wash reflector 20 may be attached at its flange 34 to the light source positioning section 14 through the use any attachment means known in the art. Alternatively, in the embodiment shown, kick reflector 32 is not attached but instead rest on the lower edge of the window 18 and light source positioning section 14. Kick reflector tab 36, extending into window 18, helps to hold wall wash reflector 20 into place.

Figure 2:
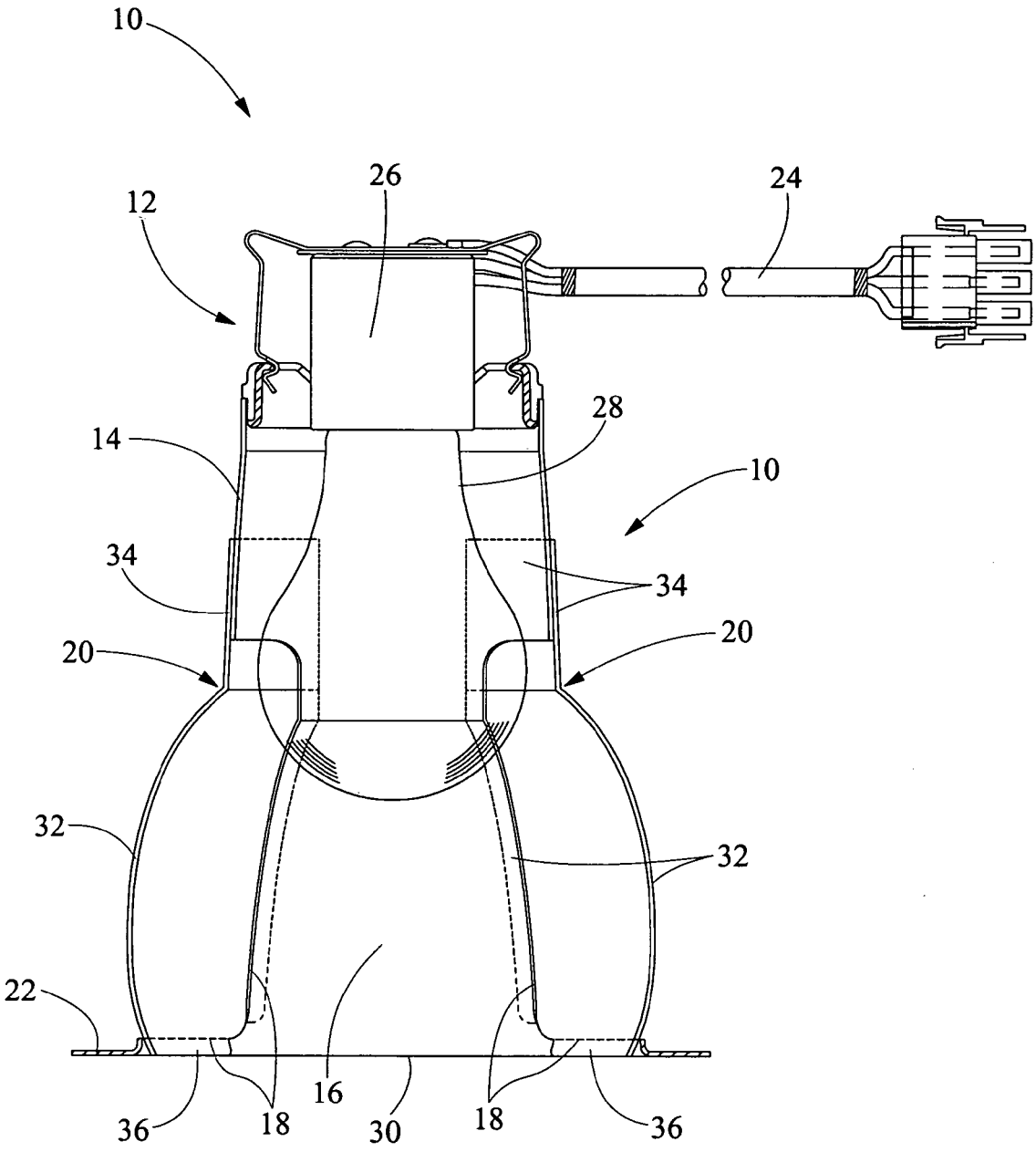
FIG. 2 is a cross-sectional view of a recessed light fixture utilizing the two wall wash reflector assemblies for placing in a hallway.

FIG. 2 shows another embodiment of a recessed downlight wall wash reflector assembly designed for use in a double (parallel) wall washer configuration such as may be used in a hall way. Socket cup receiving neck 26, light source positioning section 14, downlight reflector section 16, window cutout 18, wall wash reflector 20 and trim flange 22, shown in the previously described embodiment, are all present and function similarly in this embodiment of luminaire or wall wash reflector assembly 10.

This figure shows a cross-sectional view having a wall wash reflector 20 on each side of reflector assembly 10. This view shows kick reflector flange 34 partially enshrouding light source positioning section 14. Kick reflectors 32 are shown with solid lines at the sides of reflector assembly 10 and with phantom lines where they extend beyond window cutouts 18. Window cutouts 18 are shown with solid lines except where tabs 36 extend into window cutouts 18, they are shown with phantom lines.

Figure 3:
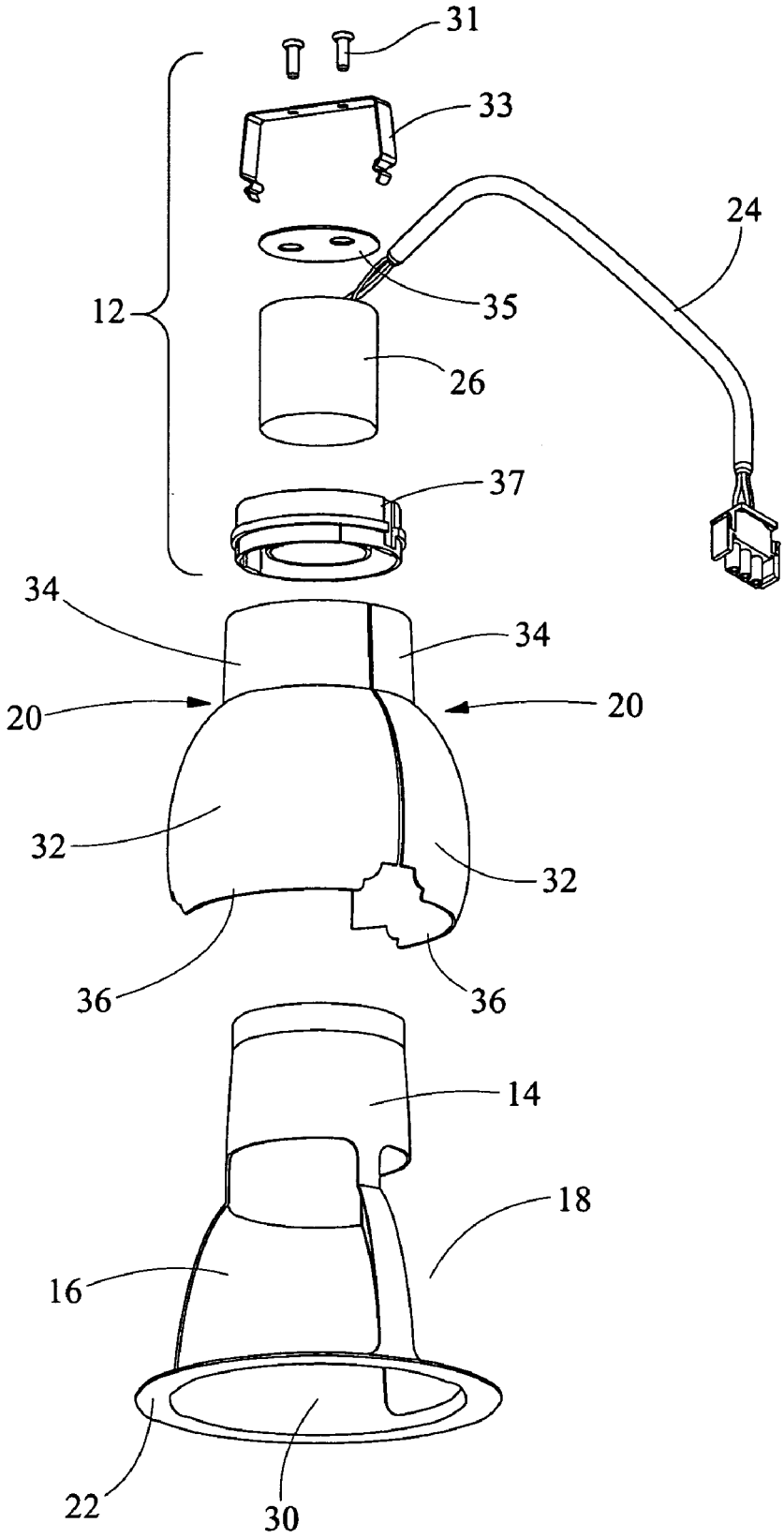
FIG. 3 is an exploded view of a recessed light fixture utilizing the two wall wash reflector assemblies for placing in a corner.

FIG. 3 shows another embodiment of a recessed downlight wall wash reflector assembly designed for use in a double (perpendicular) wall washer configuration such as may be used in a corner. This view is an exploded view showing the individual parts of the reflector assembly 10.

Wall wash reflectors 20 are depicted as being a substantially contiguous piece having different parts performing different functions. Kick reflector flange 34 surrounds a portion of light source positioning section 14 and secures wall wash reflectors 20 into place. Kick reflectors 32 perform most of the optical work in redirecting light from lamp 28 (FIG. 1) onto the walls. Tabs 36 are partial extension of kick reflectors 32. Tabs 36 are narrower than the wider section of kick reflectors 36 and are narrower than the lower horizontal width of windows 18. This configuration allows tabs 36 to pass through the lower portion of cutout windows 18 and provides reflecting to corner wall surfaces almost in the plane of flange 22. Having a reflecting surface, tabs 36, very near the plane formed by flange 22 allows luminaire 10 to light the walls nearly up to the ceiling line.

Socket assembly 12 is shown here as being comprised of retainers 31 extending through retaining clip 33 and disk 35 into socket cup receiving neck 26. Collar 37 is held around a lower portion of socket cup receiving neck 26 by retaining clip 33 and provides a means for mounting downlight reflector section 16 to socket assembly 12.

Figure 4:
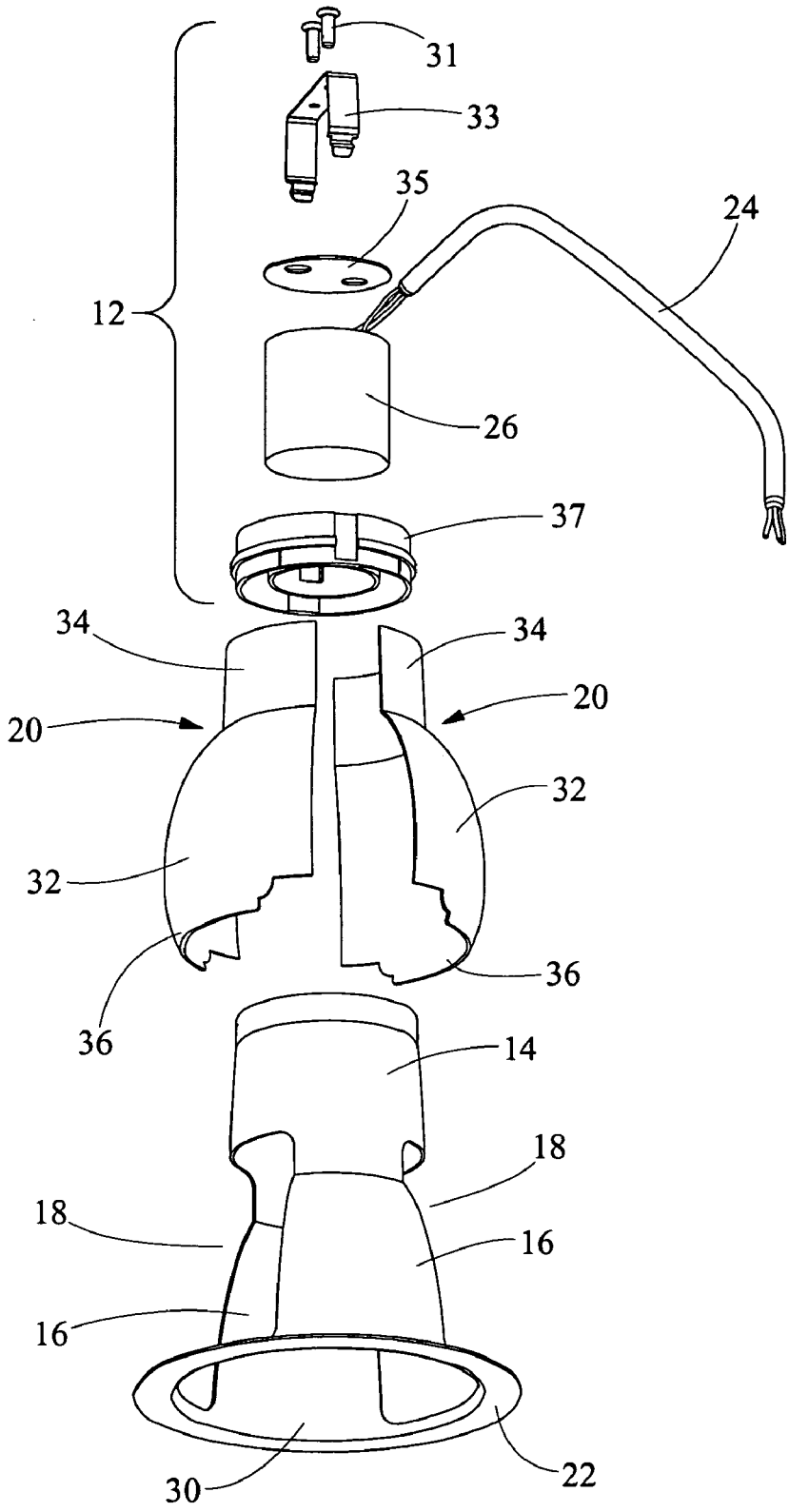
FIG. 4 is an, exploded view of a fully installed recessed light fixture utilizing the two wall wash reflector assemblies for placing in a hallway.
Figure 5B:
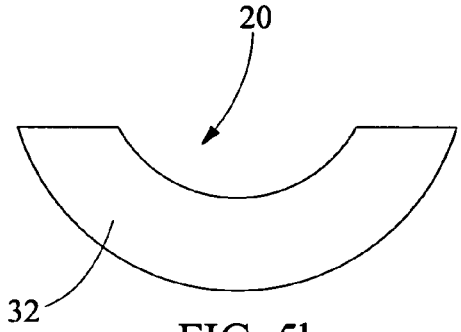
FIGS. 5*a*, 5*b*, and 5*c* are perspective views of the wall wash reflector of the present invention showing an embodiment having a rounded portion on the horizontal edges of the tab for fitting downlight reflectors having rounded edges in the wall wash windows.
Figure 5C:
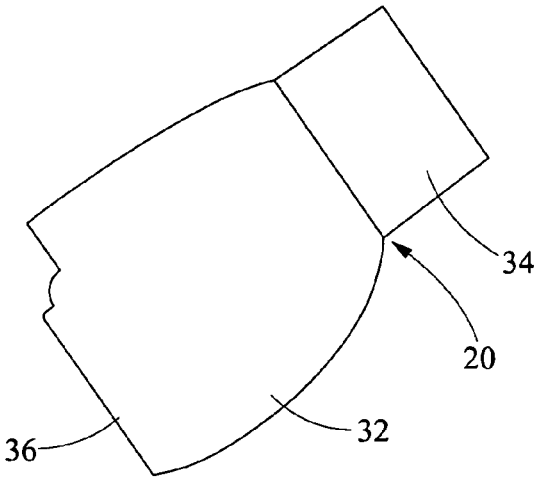
Figure 5A:
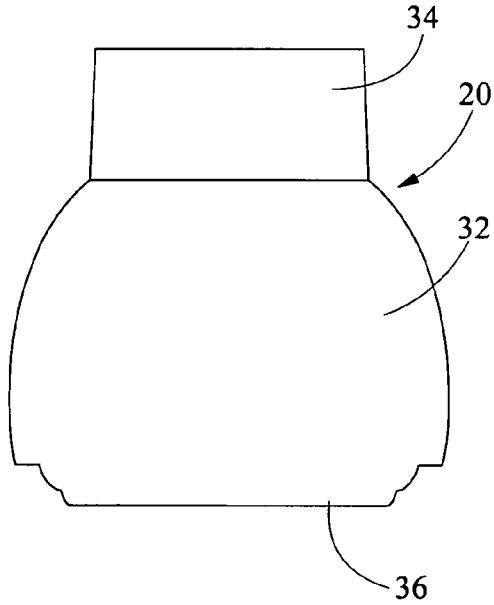

FIG. 4 is an exploded view of an embodiment of recessed light fixture 10 utilizing the two wall wash reflector assemblies for placing in a hallway. Shown in this figure is the parallel facing relationship between the two wall wash reflectors 20. Additionally, the embodiment of the wall wash reflector 20 has a curved section in tab 36 to fit within the curved surface of window cutout 18. This configuration provides for an optimum wall washing capability FIGS. 5*a*, 5*b*, and 5*c* are perspective views of the wall wash reflector 20 of the present invention showing an embodiment having a rounded portion on the horizontal edges of tab 36 for fitting into downlight reflectors 16, having matingly rounded edges in the wall wash windows 18. These figures show the details of wall wash reflector 20. Specifically, shown here in FIG. 5*a* is the narrowing of kick reflector 32 forming tab 36. Generally kick reflector 32 is wider than window 18 and extends outwardly from down light reflector 16. In order to optimize the wall washing capability of the present invention, tab 36 is narrower than window 18 so that kick reflector 32 may extend to near the plane of the ceiling. This configuration allows for a maximum angle of reflection from nadir of a fully recessed luminaire.

Additionally, the wash reflector 20 is shown as having a partial cylindrically shaped kick reflector flange 34, an ellipsoidal shaped kick reflector 32 extending downward form the kick reflector flange 34, and a tab 36 extending downward from the kick reflector 32. The tab 36 has an arc length less than the lower horizontal arc length of the kick reflector 32 and window cutout 18 in downlight reflector section 16.

Figure 6:
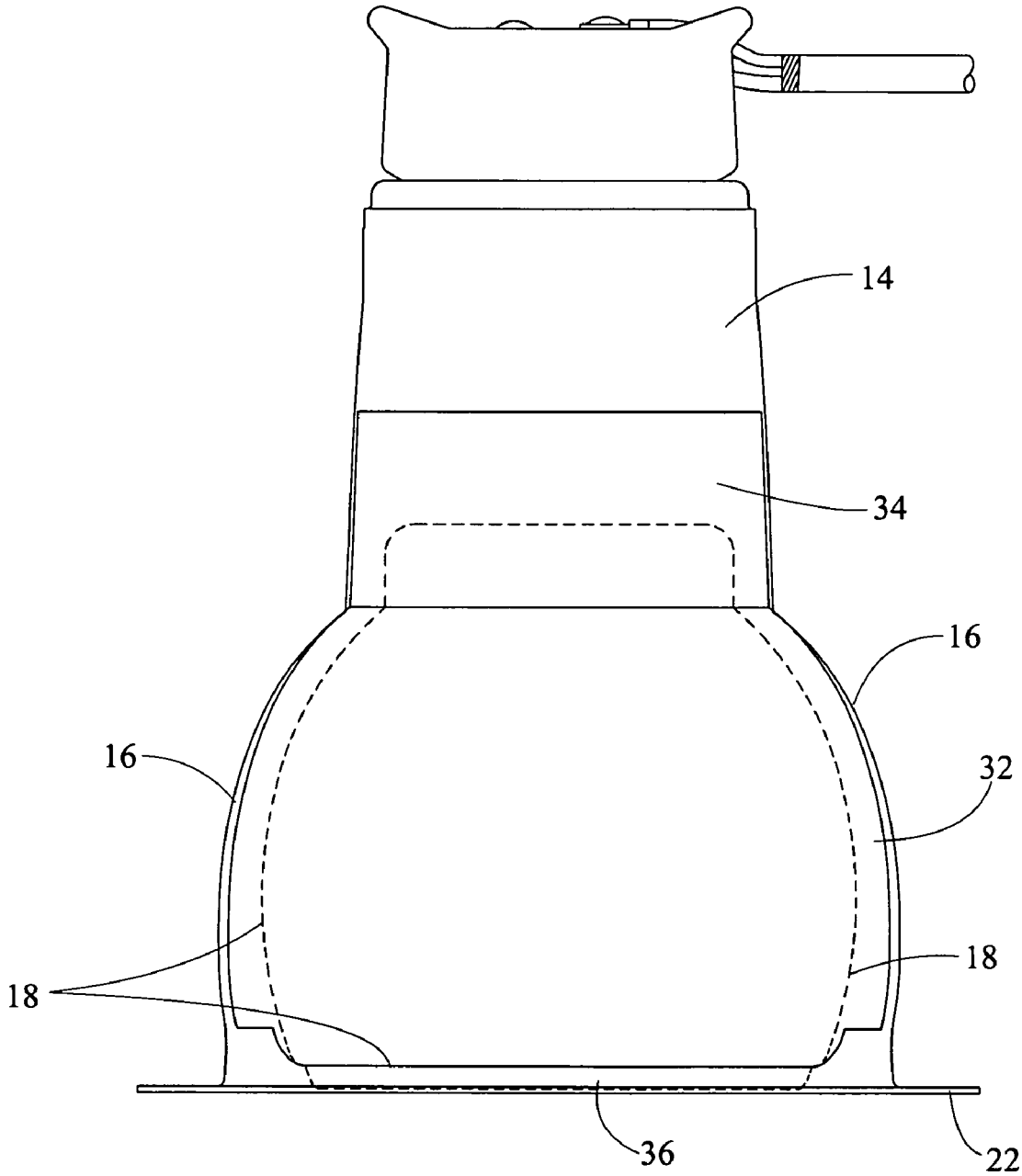
FIG. 6 is front view of an installed wall wash reflector as shown in FIG. 5*a* showing the tab of the wall wash reflector and the wall wash window in the downlight reflector in phantom lines.

FIG. 6 is front view of wall wash reflector 32 as shown in FIG. 5*a* installed into a standard recessed downlight luminaire having window cutouts 18 in the downlight reflector 16. This figure shows the tab 36 extending down from kick reflector 32 and wall wash window 18 in downlight reflector 16. Phantom lines are used to show that wall wash window 18 is located behind kick reflector 32 and kick reflector flange 34. A solid bottom line on window 18 indicates that tab 36 extends into wall wash window 18. Additionally, the lower phantom lines depicting tab 36 show tab 36 extending downwardly and inwardly toward a plane formed by flange 22.

Figure 7:
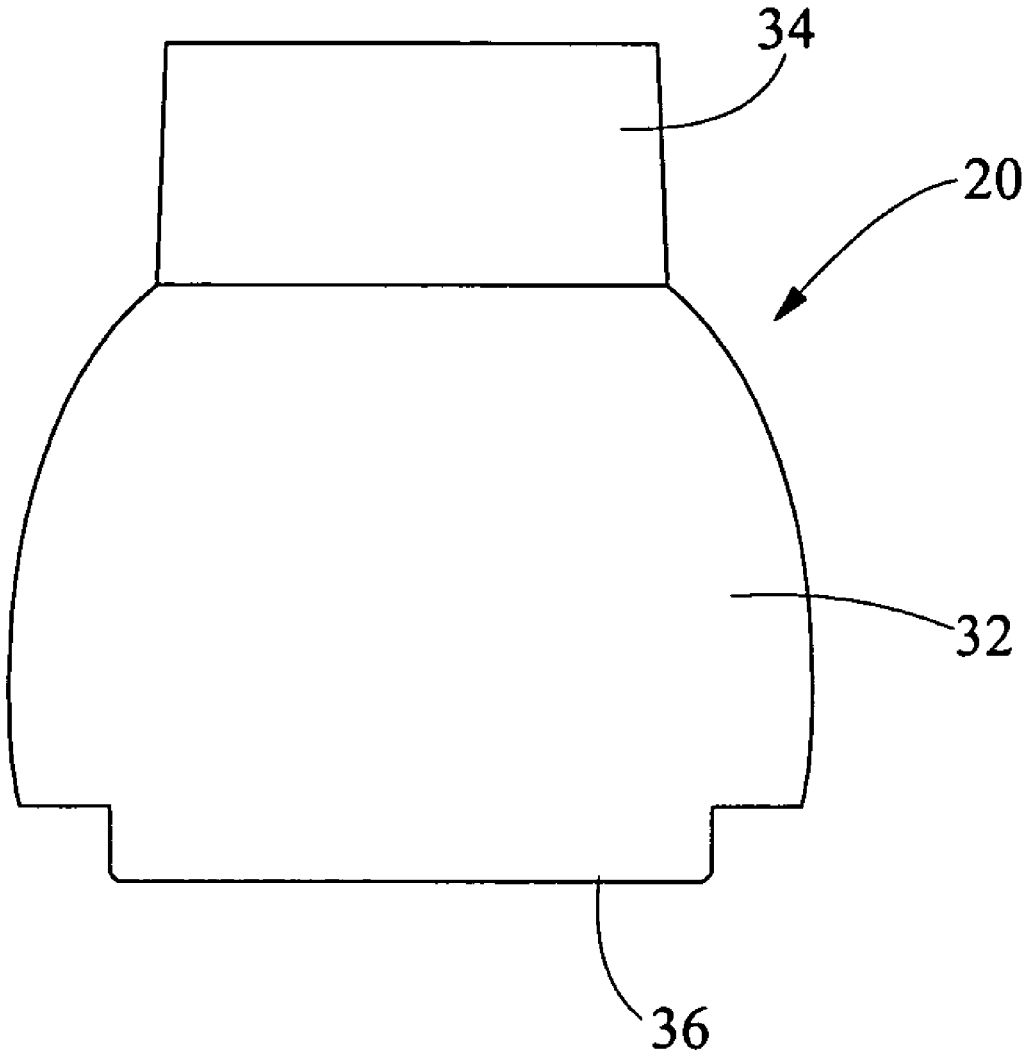
FIG. 7 is front view of an alternative embodiment of the wall wash reflector of the present invention having a tab with linear edges.

FIG. 7 is front view of an alternative embodiment of the wall wash reflector of the present invention. In this embodiment tab 36 has nearly flat vertical sides which provide a better fit within a window cutout 18 that has square corners rather than rounded corners as the embodiment shown in FIGS. 1-6.

These detailed description are given primarily for clearness of understanding and no unnecessary limitations are to be understood therefrom, for modifications will become obvious to those skilled in the art upon reading this disclosure and may be made without departing from the spirit of the present invention and scope of the appended claims.

We claim:

1. A recessed downlight reflector assembly comprising:

a downlight reflector having a sidewall with a lower edge, said sidewall having an interior and an exterior;

at least one window cutout in said sidewall; and a wall wash reflector removeably attached to said exterior of said sidewall and generally over said window cutout and having a tab with a lower edge depending into said interior of said sidewall wherein said lower edge of said tab is proximate a plane of said lower edge of said downlight reflector sidewall.

2. The recessed downlight reflector assembly of claim 1 wherein said downlight reflector sidewall has a substantially cylindrical shaped light source positioning section extending above a lower portion of said downlight reflector.

3. The recessed downlight reflector assembly of claim 2, said window cutout extending into said light source positioning section.

4. The recessed downlight reflector assembly of claim 1 wherein said downlight reflector sidewall has two of said window cutouts being proximate to each other and each of said window cutouts has a wall wash reflector having said lower edge of said tab proximate said plane of said lower edge of said downlight reflector sidewall.

5. The recessed downlight reflector assembly of claim 1 wherein said downlight reflector sidewall has two of said window cutouts being approximately opposite to each other and each of said window cutouts has a wall wash reflector having said lower edge of said tab proximate said plane of said lower edge of said downlight reflector sidewall.

6. A recessed downlight wall wash reflector assembly comprising:

a downlight reflector having a sidewall with an inside and an outside;

at least one window cutout in said sidewall of said downlight reflector;

a wall wash reflector attached to said outside of said downlight reflector sidewall generally around said window cutout; and a bottom edge of said wall wash reflector extending into said window cutout and projecting into said inside of said downlight reflector sidewall.

7. The recessed downlight wall wash reflector of claim 6 wherein said downlight reflector has two window cutouts in said sidewall of said downlight reflector, said window cutouts being substantially proximate to each other and each having a wall wash reflector generally around said window cutouts, each of said wallwash reflectors extending into a bottom edge of said window cutouts into said inside of said down light reflector sidewall.

8. The recessed downlight wall wash reflector of claim 6 wherein said downlight reflector has two window cutouts in said sidewall of said downlight reflector, said window cutouts being approximately opposite to each other and each having a wall wash reflector generally around said window cutouts, each of said wallwash reflectors extending into a bottom edge of said window cutouts into said inside of said down light reflector sidewall.

9. A wall wash reflector comprising:

a partial cylindrically shaped kick reflector flange;

an ellipsoidal shaped kick reflector extending generally downward and outward from said kick reflector flange; and a tab extending downwardly and inwardly from said kick reflector, said tab having a horizontal arc length less than the lower horizontal arc length of said kick reflector.

10. The wall wash reflector of claim 9 wherein said kick reflector flange, said kick reflector, and said tab are of a unitary construction.

11. The wall wash reflector of claim 10 wherein said tab has a rounded section in each side edge.

12. The wall wash reflector of claim 10 wherein said tab has nearly linear side edges.

13. A recessed luminaire having a downlight reflector and a means for washing a wall with light, said means for washing a wall with light is a wall wash reflector having a reflective surface in light communication with a lamp, said reflective surface extending downward and having a lower edge forming a light exit aperture, an upper portion of said wall wash reflector being positioned externally about a window in said downlight reflector, said wall wash reflector having a lower tab near said aperture, said tab having a rounded section in an opposed pair of side edges.

14. A recessed luminaire having a downlight reflector and a means for washing a wall with light, said means for washing a wall with light is a wall wash reflector having a reflective surface in light communication with a lamp, said reflective surface extending downward and having a lower edge forming a light exit aperture, an upper portion of said wall wash reflector being positioned externally about a window in said downlight reflector, said wall wash reflector having a lower tab near said aperture, said tab having a nearly linear surface in an opposed pair of side edges.

15. A luminaire comprising:

a downlight reflector section having a bell shaped lower section forming a light exit aperture and a cylindrical upper section;

at least one window in said bell shaped lower section of said downlight reflector section; and a kick reflector surrounding each of said at least one window and having a lower tab extending into said at least one window.

16. The luminaire of claim 15 wherein said lower tab of said kick reflector has a reflective surface extending downward to a light exit aperture of said luminaire.

17. The luminaire of claim 15 wherein said lower tab of said kick reflector has an arc length less than a lower arc length of said at least one window.

18. A luminaire comprising:

a downlight reflector having a lower edge;

at least one window cutout in said downlight reflector above said lower edge; and at least one wall wash reflector removeably attached to an outer surface of said downlight reflector, each of said at least one wall wash reflectors being external and generally over each of said at least one window cutout and each having a lower tab extending into a lower portion of each of said at least one window cutout.

* * * * *